US010538415B2

(12) United States Patent
Maruyama

(10) Patent No.: US 10,538,415 B2
(45) Date of Patent: Jan. 21, 2020

(54) CEILING UNIT AND ELEVATOR CAR INCLUDING CEILING UNIT

(71) Applicant: MITSUBISHI ELECTRIC CORPORATION, Chiyoda-ku (JP)

(72) Inventor: Naoyuki Maruyama, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 314 days.

(21) Appl. No.: 15/323,255

(22) PCT Filed: Sep. 8, 2014

(86) PCT No.: PCT/JP2014/004598
§ 371 (c)(1),
(2) Date: Dec. 30, 2016

(87) PCT Pub. No.: WO2016/038642
PCT Pub. Date: Mar. 17, 2016

(65) Prior Publication Data

US 2017/0137261 A1 May 18, 2017

(51) Int. Cl.
*B66B 11/02* (2006.01)

(52) U.S. Cl.
CPC ..... *B66B 11/0226* (2013.01); *B66B 11/02* (2013.01)

(58) Field of Classification Search
CPC ..... B66B 11/0206; B66B 11/0226; B66B 11/0246; B66B 11/0253; B66B 11/0273; B66B 5/0087
See application file for complete search history.

(56) References Cited

U.S. PATENT DOCUMENTS 600,759 A * 3/1898 Williams et al. ... B66B 11/0226 187/401
4,043,430 A * 8/1977 Kraft ..... B66B 11/0226 187/324
H001362 H * 10/1994 Herrmann ..... B66B 13/08 187/324
6,209,686 B1 4/2001 Tomasetti et al.
7,140,473 B2 * 11/2006 Det ..... B66B 5/0081 187/401

(Continued)

FOREIGN PATENT DOCUMENTS

JP 61-101572 U 6/1986
JP 1-98586 A 4/1989

(Continued)

OTHER PUBLICATIONS

Office Action dated Jun. 27, 2017 in Japanese Patent Application No. 2016-547256 (with partial English language translation).

(Continued)

*Primary Examiner* — Minh Truong
(74) *Attorney, Agent, or Firm* — Xsensus LLP

(57) ABSTRACT

A ceiling unit includes a first side beam supported by at least one of a plurality of upright columns erected on a floor plate of an elevator car, a second side beam supported parallel to the first side beam by a different upright column, among the plurality of upright columns, from the upright column supporting the first side beam, a rear beam that connects respective rear side end portions of the first and second side beams, and a ceiling plate supported by the first and second side beams and the rear beam.

10 Claims, 5 Drawing Sheets

(56) References Cited

U.S. PATENT DOCUMENTS

| | | | | |
|---|---|---|---|---|
| 8,365,870 | B2 * | 2/2013 | Sirigu | B66B 5/0068 187/306 |
| 8,528,702 | B2 | 9/2013 | Maury | |
| 9,441,359 | B1 * | 9/2016 | Hsieh | E04B 1/24 |
| 9,657,475 | B1 * | 5/2017 | Steele | A62C 35/68 |
| 2010/0144265 | A1 * | 6/2010 | Bednarcik | H05K 7/20745 454/184 |
| 2018/0370769 | A1 * | 12/2018 | Haivala | B66B 11/0206 |

FOREIGN PATENT DOCUMENTS

| | | | |
|---|---|---|---|
| JP | 10-231078 | A | 9/1998 |
| JP | 2000-226172 | A | 8/2000 |
| JP | 2004-262602 | A | 9/2004 |
| JP | 2011-190059 | A | 9/2011 |
| JP | 2014-91586 | A | 5/2014 |
| JP | 2014-159324 | A | 9/2014 |
| WO | 2011/036685 | A1 | 3/2011 |
| WO | 2011/036686 | A1 | 3/2011 |

OTHER PUBLICATIONS

Extended European Search Report dated Apr. 10, 2018 in Patent Application No. 14901601.6, 6 pages.
International Search Report dated Dec. 16, 2014 in PCT/JP14/004598 Filed Sep. 8, 2014.

* cited by examiner

CEILING UNIT AND ELEVATOR CAR INCLUDING CEILING UNIT

TECHNICAL FIELD

This invention relates to a ceiling unit and an elevator car that includes the ceiling unit.

BACKGROUND ART

A conventional elevator includes a car frame supported by a hoisting machine rope, and the car frame is constituted by a lower frame, upright columns, and an upper frame. A cab that passengers enter and leave is supported in the interior of the car frame. The car frame and the cab are separate structures, and therefore sufficient strength must be secured in each. For example, the upper frame of the car frame must be strong enough to be able to withstand an offset load acting on a floor plate of the cab, while a ceiling plate of the cab must be strong enough to be able to withstand the weight of a maintenance worker or a heavy component placed thereon during installation or maintenance. In a conventional elevator, strength must be secured in both the upper frame and the ceiling plate, leading to overall increases in the number of components and the mass of the elevator.

An elevator in which an upper frame supported by upright columns and a ceiling plate supported by side walls of a cab are arranged on an identical plane has been proposed in response to this problem (see PTL 1, for example). In PTL 1, the number of components and the mass are reduced by employing the upper frame as a part of the ceiling.

CITATION LIST

Patent Literature

[PTL 1] Japanese Patent Application Publication No. 2011-190059 (page 5, FIG. 2)

SUMMARY OF INVENTION

Technical Problem

In the elevator car described in PTL 1, however, the ceiling plate disposed on the periphery of the upper frame is still attached to the side walls of the cab. Therefore, although the number of components can be reduced, members exhibiting superior strength must be used for the side walls, making it impossible to achieve an overall reduction in mass.

This invention has been designed to solve the problem described above, and an object thereof is to obtain a ceiling unit with which the number of components and the mass of an elevator car can be reduced, and an elevator car in which the number of components and the mass thereof have been reduced.

Solution to Problem

A ceiling unit according to a first aspect of this invention includes a first side beam supported by at least one of a plurality of upright columns erected on a floor plate of an elevator car, a second side beam supported parallel to the first side beam by a different upright column, among the plurality of upright columns, from the upright column supporting the first side beam, a rear beam that connects respective rear side end portions of the first and second side beams, and a ceiling plate supported by the first and second side beams and the rear beam.

Advantageous Effects of Invention

According to this invention, the number of components and the mass of the elevator car can be reduced.

DESCRIPTION OF EMBODIMENTS

First Embodiment

Figure 1:
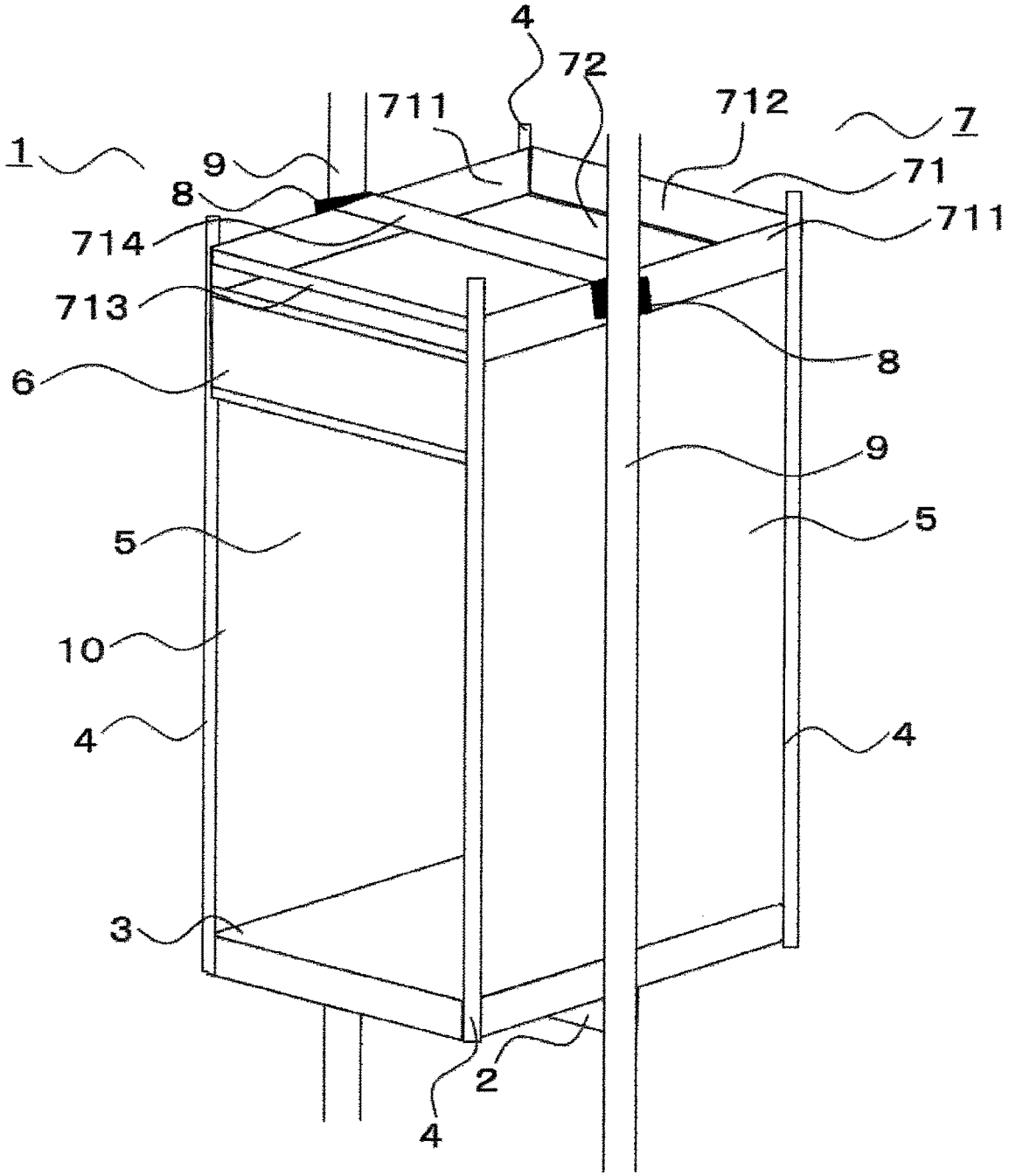
FIG. 1 is a perspective view showing an elevator car according to a first embodiment of this invention.

FIG. 1 is a perspective view showing an elevator car according to a first embodiment of this invention. In FIG. 1, a car 1 is constituted by a lower frame 2 including a safety device, a cab, a ceiling unit 7 forming a ceiling portion of the cab, and guide shoes 8 provided on the ceiling unit 7, while the cab includes a floor plate 3 provided on the lower frame 2, upright columns 4 erected in the four corners of the floor plate 3, a pair of side walls 5 forming side faces of the car, a front facing wall (not shown) provided opposite a doorway 10, a car door (not shown) for opening and closing the doorway 10, and an end rail 6 provided above the doorway 10.

When the car 1 ascends and descends through a hoistway, the car 1 is guided by guide rails 9 provided in the hoistway via the guide shoes 8.

Figure 2:
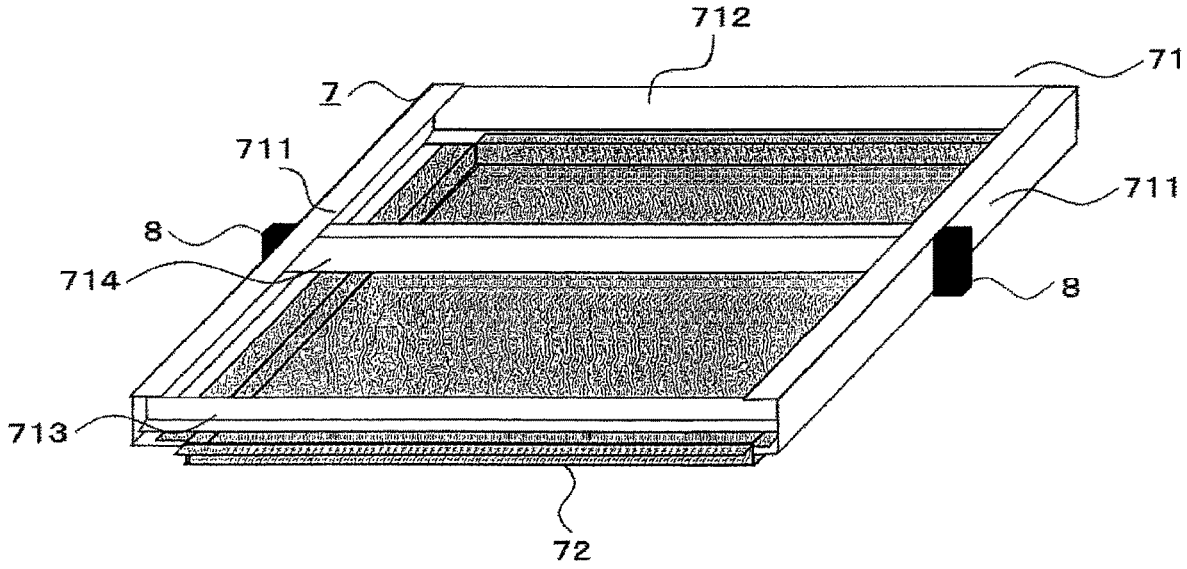
FIG. 2 is a perspective view showing a ceiling unit according to the first embodiment of this invention.

FIG. 2 is a perspective view showing the ceiling unit 7 according to the first embodiment of this invention. In FIG. 2, the ceiling unit 7 is constituted by an upper frame 71 and a ceiling plate 72. The upper frame 71 is constituted by first and second side beams (referred to hereafter as a pair of side beams) 711 arranged parallel to each other via a gap in a frontage direction of the doorway 10, a rear beam 712 that connects respective far side (rear side) end portions of the pair of side beams 711, a front beam 713 that connects respective front side end portions (doorway 10 side end portions) of the pair of side beams 711, and an upper beam 714 that connects respective central portions of the pair of side beams 711. When the pair of side beams 711, the rear beam 712, and the front beam 713 are joined together, the upper frame 71 takes a rectangular shape.

Next, the upper frame 71 will be described in detail using FIGS. 3 to 5.

Each side beam 711 is formed by bending a single sheet of steel. First, the steel sheet is disposed so that a long side thereof is horizontal and a short side is vertical, whereupon an upper portion thereof is bent to a horizontal position. Next, a front side part of a lower portion of the steel sheet is bent to a horizontal position in the same direction as the upper side edge portion while leaving unbent a part thereof having a dimension that corresponds to a front-rear dimension of a horizontal portion 712*a* of the rear beam 712, to be described below, from a far side end face. As a result, the side beam 711 has a U-shaped cross-section on the front side and an L-shaped cross-section on the far side. The pair of side beams 711 are arranged parallel to each other via a gap in the frontage direction of the doorway 10 so that respective opening portions of the U shapes thereof oppose each other.

Figure 3:
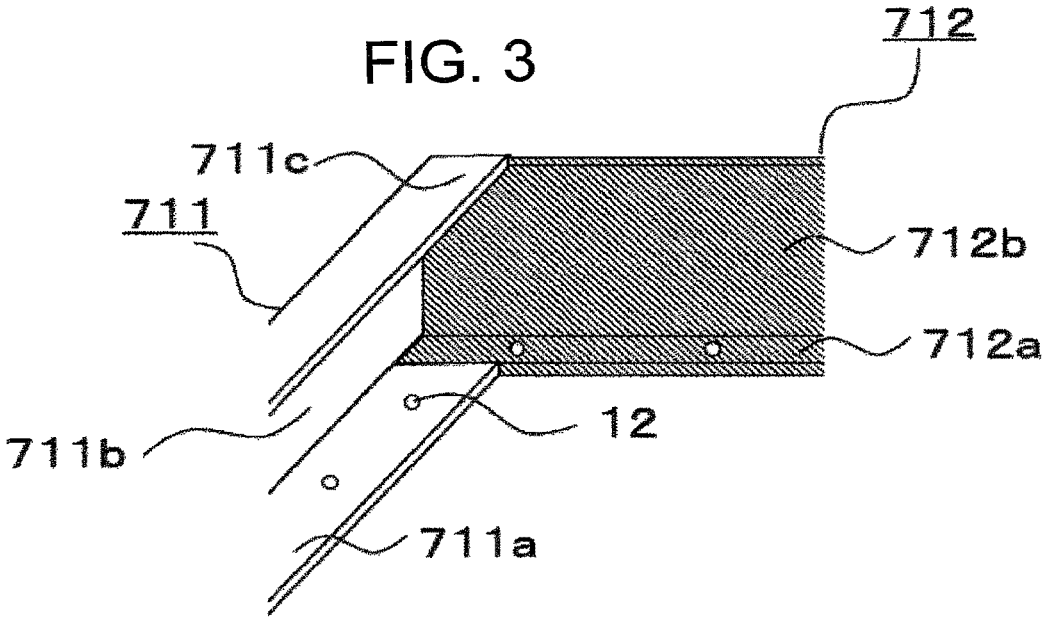
FIG. 3 is an enlarged view showing a connecting portion between a side beam and a rear beam.

FIG. 3 is an enlarged view showing a connecting part between one of the side beams 711 and the rear beam 712.

The opening portions of the U shapes on the front sides of the pair of side beams 711 are each constituted by two horizontal portions 711*a, c*, and one vertical portion 711*b* provided between the two horizontal portions 711*a, c* so as to form a bottom portion of the U shape. Here, the horizontal portion positioned on the lower side, of the two horizontal portions 711*a, c*, will be referred to as a lower horizontal portion 711*a*, and the horizontal portion positioned on the upper side will be referred to as an upper horizontal portion 711*c*. An upper face of the lower horizontal portion 711*a* serves as a contact surface that contacts and is fastened to the ceiling plate 72, to be described below. Further, respective far sides of the pair of side beams 711 are each constituted by the vertical portion 711*b* and the upper horizontal portion 711*c* so as to have L-shaped cross-sections. Note that a length from a front side end face to a far side end face of the lower horizontal portion 711*a* is shorter than a length from a front side end face to a far side end face of the vertical portion 711*b* and the upper horizontal portion 711*c* by an amount corresponding to the front-rear dimension of the horizontal portion 712*a* of the rear beam 712. Furthermore, the far side of the steel sheet, which remains after the lower horizontal portion 711*a* is formed, extends vertically downward so as to form the vertical portion 711*b*.

The rear beam 712 is molded by bending one side of a long side of a steel sheet upward, and therefore has an L-shaped cross-section. The L-shaped rear beam 712 includes the horizontal portion 712*a*, and a vertical portion 712*b* extending upward from the horizontal portion 712*a*. An upper face of the horizontal portion 712*a* serves as a contact surface that contacts and is fastened to the ceiling plate 72, to be described below. A short side dimension of the vertical portion 712*b* is set to be identical to a short side dimension of the vertical portion 711*b* of the side beam 711.

One lengthwise direction end portion of the rear beam 712 is welded to a far side end portion of one of the side beams 711. More specifically, a front face of one lengthwise direction end portion of the horizontal portion 712*a* is brought into contact with the far side end face of the lower horizontal portion 711*a*, an end face of the horizontal portion 712*a* on the side beam 711 side is brought into contact with a side face of the vertical portion 711*b* on the rear beam 712 side, an end face of the vertical portion 712*b* on the side beam 711 side is brought into contact with the side face of the vertical portion 711*b* on the rear beam 712 side, and an upper end face of the vertical portion 712*b* is brought into contact with a lower face of the upper horizontal portion 711*c*. In this condition, the horizontal portion 712*a* is welded to the lower horizontal portion 711*a*, the horizontal portion 712*a* is welded to the vertical portion 711*b*, the vertical portion 712*b* is welded to the vertical portion 711*b*, and the upper horizontal portion 711*c* is welded to the vertical portion 712*b*. The other side beam 711 is welded to the other lengthwise direction end portion of the rear beam 712 in a similar manner. As a result, the rear beam 712 connects the respective far side end portions of the pair of side beams 711. Here, the respective upper faces of the lower horizontal portions 711*a* of the pair of side beams 711 and the upper face of the horizontal portion 712*a* of the rear beam 712 are disposed on an identical horizontal plane (A). Further, bolt holes 12 are provided in the lower horizontal portions 711*a* of the side beams 711 and the horizontal portion 712*a* of the rear beam 712. The side beams 711 and the rear beam 712 are fastened to the ceiling plate 72, to be described below, via the bolt holes 12.

Figure 4:
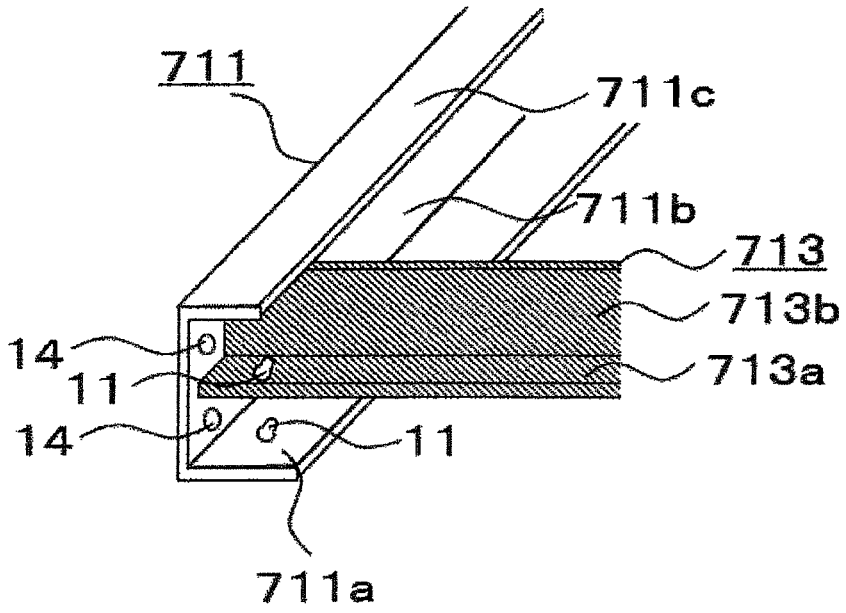
FIG. 4 is an enlarged view showing a connecting portion between the side beam and a front beam.

FIG. 4 is an enlarged view showing a connecting part between one of the side beams 711 and the front beam 713.

The front beam 713 is molded by bending one side of a long side of a steel sheet upward, and therefore has an L-shaped cross-section. The L-shaped front beam 713 is shaped identically to the rear beam 712, but is smaller than the rear beam 712. The front beam 713 includes a horizontal portion 713*a* that is parallel to the horizontal portion 712*a* of the rear beam 712, and a vertical portion 713*b* that extends upward from the horizontal portion 713*a*. A short side dimension of the vertical portion 713*b* is set to be shorter than the short side dimension of the vertical portion 711*b* of the side beam.

One lengthwise direction end portion of the front beam 713 is welded to a front side (a doorway 10 side) end portion of one of the side beams 711. More specifically, an upper face of the vertical portion 713*b* of the front beam 713 is brought into contact with the lower face of the upper horizontal portion 711*c* of the side beam 711. An end face of the horizontal portion 713*a* of the front beam 713 on the side beam 711 side is brought into contact with a side face of the vertical portion 711*b* of the side beam 711 on the front beam 713 side. An end face of the vertical portion 713*b* of the front beam 713 on the side beam 711 side is brought into contact with the side face of the vertical portion 711*b* of the side beam 711 on the front beam 713 side. In this condition, the upper horizontal portion 711*c* is welded to the vertical portion 713*b*, the vertical portion 713*b* is welded to the vertical portion 711*b*, and the horizontal portion 713*a* is welded to the vertical portion 711*b*. The other lengthwise direction end portion of the front beam 713 is welded to the front side end portion of the other side beam 711 in a similar manner. As a result, the front beam 713 connects the respective front side end portions of the pair of side beams 711. Here, a vertical dimension of the vertical portion 713*b* of the front beam 713 is set to be shorter than a vertical dimension of the vertical portion 711*b* of the side beam 711. Accordingly, a lower face of the horizontal portion 713*a* of the front beam 713 is disposed above the upper face of the lower horizontal portion 711*a* of the side beam 711 at a remove from the upper face of the lower horizontal portion 711*a*.

Figure 5:
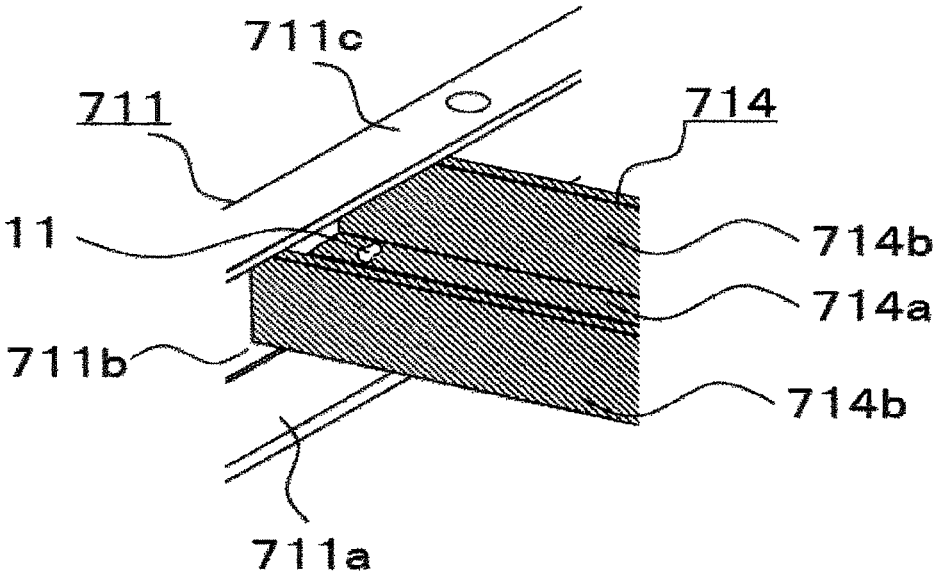
FIG. 5 is an enlarged view showing a connecting portion between the side beam and an upper beam.

FIG. 5 is an enlarged view showing a connecting part between one of the side beams 711 and the upper beam 714.

The upper beam 714 is molded by bending a steel sheet so as to obtain a U-shaped cross-section. The upper beam 714 is disposed such that an opening portion of the U shape is oriented upward. The U-shaped opening portion of the upper beam 714 is constituted by two vertical portions 714*b* and one horizontal portion 714*a* provided between the two vertical portions 714*b* so as to form a bottom portion of the U shape. Here, a vertical dimension of each of the two vertical portions 714*b* of the upper beam 714 is set to be shorter than the vertical dimension of the vertical portion 711*b* of the side beam 711 and identical to the vertical dimension of the vertical portion 713*b* of the front beam 713.

One lengthwise direction end portion of the upper beam 714 is welded to a central portion of one of the side beams 711. More specifically, an end face of the horizontal portion 714*a* of the upper beam 714 on the side beam 711 side is brought into contact with a side face of the vertical portion 711*b* of the side beam 711 on the upper beam 714 side. Respective end faces of the two vertical portions 714*b* on the side beam 711 side are brought into contact with the side face of the vertical portion 711*b* of the side beam 711 on the upper beam 714 side. Respective upper faces of the two vertical portions 714*b* are brought into contact with the lower face of the upper horizontal portion 711*c* of the side beam 711. In this condition, the horizontal portion 714*a* is welded to the vertical portion 711*b*, the two vertical portions 714*b* are welded to the vertical portion 711*b*, and the vertical portion 714*b* is welded to the upper horizontal portion 711*c*. The other lengthwise direction end portion of the upper beam 714 is welded to the central portion of the other side beam 711 in a similar manner. As a result, the upper beam 714 connects the respective central portions of the pair of side beams 711. Here, the vertical dimension of each of the two vertical portions 714*b* of the upper beam 714 is set to be shorter than the vertical dimension of the vertical portion 711*b* of the side beam 711 and identical to the vertical dimension of the vertical portion 713*b* of the front beam 713. Accordingly, the lower face of the horizontal portion 713*a* of the front beam 713 and a lower face of the horizontal portion 714*a* of the upper beam 714 are disposed on an identical horizontal plane (B). The horizontal plane (B) is positioned above the horizontal plane (A) on which the lower faces of the lower horizontal portions 711*a* of the side beams 711 and the lower face of the horizontal portion 712*a* of the rear beam 712 are disposed.

Note that the steel sheets used to form the respective beams have a typical structure and a prescribed strength. Further, the beams may be formed using different steel sheets as long as the resulting beams are rigid.

Figure 6:
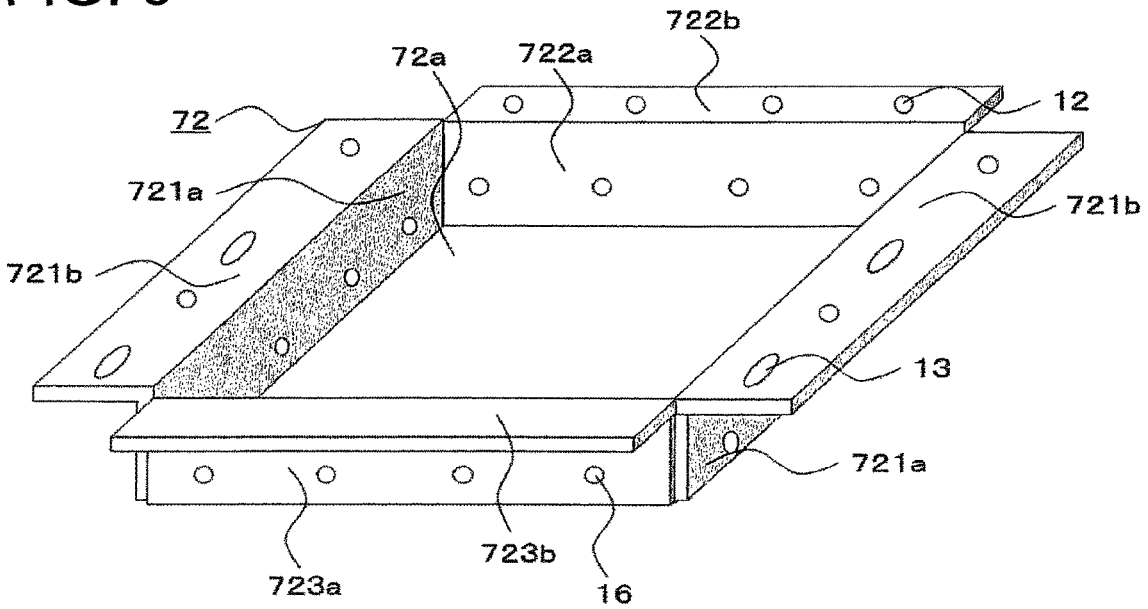
FIG. 6 is a perspective view showing a ceiling plate.

Next, the ceiling plate 72 will be described in detail using FIG. 6. FIG. 6 is a perspective view of the ceiling plate 72.

The ceiling plate 72 includes first and second vertical portions (referred to hereafter as a pair of side vertical portions) 721*a* molded by bending a pair of opposing sides of a rectangular plate toward an upper side of the car 1. Of the two remaining sides, a side on the far side of the car 1 is bent toward the upper side of the car 1 so as to form a third vertical portion (referred to hereafter as a rear vertical portion) 722*a*, and the remaining side on the front of the car 1 is likewise bent toward the upper side of the car 1 so as to form a fourth vertical portion (referred to hereafter as a front vertical portion) 723*a*. An upper portion of each side vertical portion 721*a* is bent toward an opposite side to the other side vertical portion 721*a*, and as a result, first and second horizontal portions (referred to hereafter as a pair of side horizontal portions) 721*b* are formed. An upper portion of the rear vertical portion 722*a* is bent toward an opposite side to the front vertical portion 723*a* so as to form a third horizontal portion (referred to hereafter as a rear horizontal portion) 722*b*. An upper portion of the front vertical portion 723*a* is bent toward an opposite side to the rear vertical portion 722*a* so as to form a fourth horizontal portion (referred to hereafter as a front horizontal portion) 723*b*. The side horizontal portions 721*b*, the rear horizontal portion 722*b*, and the front horizontal portion 723*b* are connected to respective upper end portions of the side vertical portions 721*a*, the rear vertical portion 722*a*, and the front vertical portion 723*a* so as to extend outwardly therefrom. Further, a bottom portion 72*a* is formed between respective lower end portions of the side vertical portions 721*a*, the rear vertical portion 722*a*, and the front vertical portion 723*a*. The bottom portion 72*a* connects the respective lower end portions of the side vertical portions 721*a*, the rear vertical portion 722*a*, and the front vertical portion 723*a*. An upper face of the bottom portion 72*a* serves as a canopy on which a maintenance worker stands or on which heavy components are placed during installation or maintenance, while a lower face thereof serves as a design surface used as a ceiling surface of the cab interior.

Next, a method of fastening the ceiling plate 72 to the upper frame 71 will be described.

Bolt holes 16 are formed in the side vertical portions 721*a*, the rear vertical portion 722*a*, and the front vertical portion 723*a*. The side vertical portions 721*a*, the rear vertical portion 722*a*, and the front vertical portion 723*a* are fastened to respective upper end portions of the side walls 5, an upper end portion of the front facing wall (not shown), and an upper end portion of the end rail 6 via the bolt holes 16.

Respective upper faces of the lower horizontal portions 711*a* of the side beams 711 and the horizontal portion 712*a* of the rear beam 712 serve as contact surfaces that contact respective lower surfaces of the side horizontal portions 721*b* and the rear horizontal portion 722*b* of the ceiling plate 72, respectively. Further, bolt holes 12 are provided in the side horizontal portions 721*b* and the rear horizontal portion 722*b*. The side horizontal portions 721*b* and the rear horizontal portion 722*b* are fastened to the lower horizontal portions 711*a* of the respective side beams 711 and the horizontal portion 712*a* of the rear beam 712, respectively, via the bolt holes 12. The front horizontal portion 723*b* does not contact the front beam 713.

Figure 7:
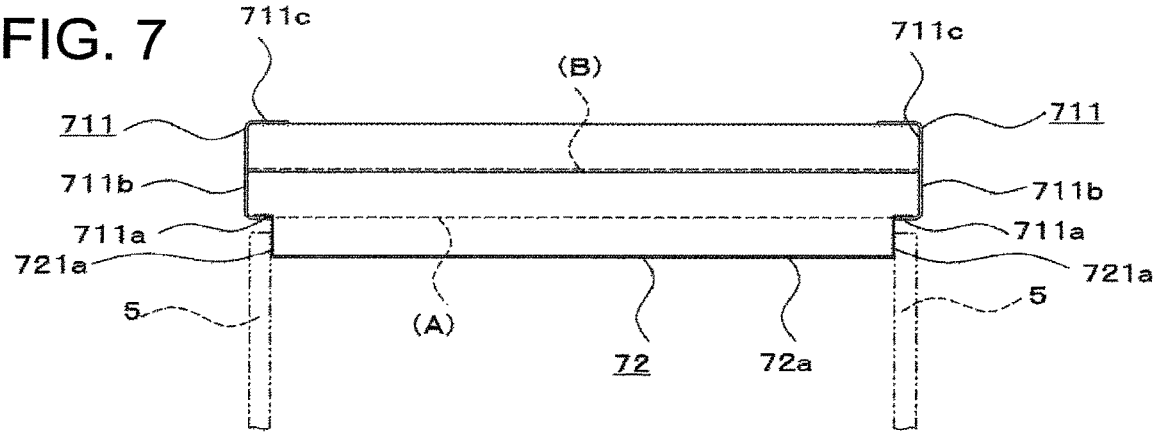
FIG. 7 is a front view showing the ceiling unit according to the first embodiment of this invention in an installation condition.

FIG. 7 is a view showing the ceiling unit 7 from the doorway 10 side. The ceiling plate 72 is mounted on the upper frame 71 from the front beam 713 side such that the canopy faces upward and the design surface faces downward. At this time, the side horizontal portions 721*b* of the ceiling plate 72 are inserted between the horizontal plane (A) on which the lower horizontal portions 711*a* of the pair of side beams 711 and the horizontal portion 712*a* of the rear beam 712 of the upper frame 71 are disposed and the horizontal plane (B) on which the horizontal portion 713*a* of the front beam 713 and the horizontal portion 714*a* of the upper beam 714 are disposed. The lower surfaces of the side horizontal portions 721*b* of the ceiling plate 72 respectively contact the upper surfaces of the lower horizontal portions 711*a* of the side beams 711. Similarly, the lower surface of the rear horizontal portion 722*b* of the ceiling plate 72 contacts the upper surface of the horizontal portion 712*a* of the rear beam 712. Through the bolt holes 12, the lower horizontal portions 711*a* of the side beams 711 are fastened and fixed to the side horizontal portions 721*b* of the ceiling plate 72 by bolts, and the horizontal portion 712*a* of the rear beam 712 is fastened and fixed to the horizontal portion 722*b* of the ceiling plate 72 by bolts. As a result, the ceiling unit 7 shown in FIG. 2 is formed.

Here, in the ceiling plate 72, the bottom portion 72*a* forming the design surface and the canopy, the vertical portions 721*a*, 722*a*, 723*a*, and the horizontal portions 721*b*, 722*b*, 723*b* are all formed from a single plate. Further, the horizontal portions 721*b*, 722*b* of the ceiling plate 72 contact the upper faces of the lower horizontal portions 711*a* of the side beams 711 and the horizontal portion 712*a* of the rear beam 712, respectively, over the entire lengths thereof. As a result, the ceiling plate 72 can be prevented from falling even when the ceiling plate 72 becomes unfastened from the side beams 711 and the rear beam 712.

Figure 9:
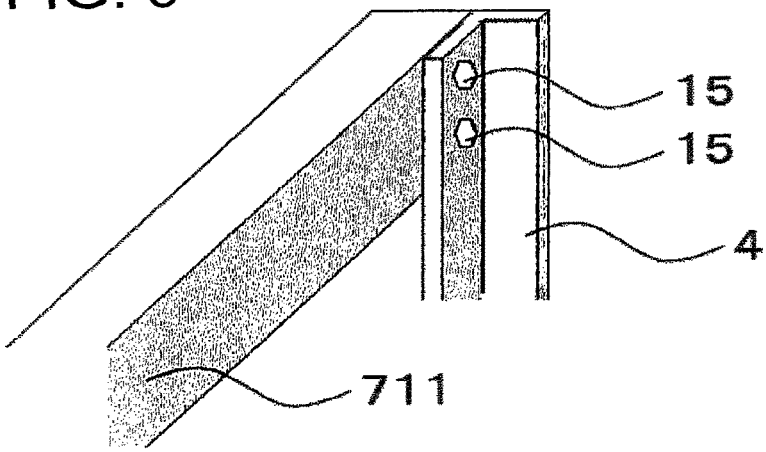
FIG. 9 is an enlarged view showing a connecting portion between the side beam and an upright column.

Procedures for installing the car 1 when the ceiling unit 7 having the above configuration is employed will now be described using FIGS. 1, 9, and 10.

First, the floor plate 3 is disposed on the lower frame 2 and adjusted so as to be horizontal. Next, the upright columns 4 are erected in the four corners of the floor plate 3. The ceiling unit 7 is then fastened to the upper portions of the upright columns 4. Bolt holes 14 are provided in the vertical portions 711*b* of the side beams 711 and upper portions of the upright columns 4, and through the bolt holes 14, the vertical portions 711*b* of the side beams 711 are fastened to the upper portions of the upright columns 4 by bolts 15. FIG. 9 is an enlarged view showing a fastening portion between the side beam 711 and the upright column 4. As shown in FIG. 9, the upright column 4 is brought into contact with an outer face of the vertical portion 711*b* of the side beam 711 (a side face on the opposite side to the surface thereof that contacts the front beam 713), and then fastened to the side beam 711 by the bolts 15.

After fastening the ceiling unit 7 to the upright columns 4, the side walls 5 are erected on the floor plate 3, whereupon the side walls 5 are fastened to the side vertical portions 721*a* of the ceiling plate 72 and the floor plate 3 by bolts 17. The front facing wall (not shown) is fastened to an outer face of the rear vertical portion 722*a* of the ceiling plate 72 (a side face thereof on the opposite side to the front vertical portion 723*a*) and the floor plate 3 by the bolts 17. The end rail 6 is fastened to an outer face of the front vertical portion 723*a* of the ceiling plate 72 (a side face thereof on the opposite side to the rear vertical portion 722*a*) by the bolts 17. At this point, the car 1 is in the condition shown in FIG. 1. Finally, the car door (not shown) is attached to the doorway 10.

Figure 10:
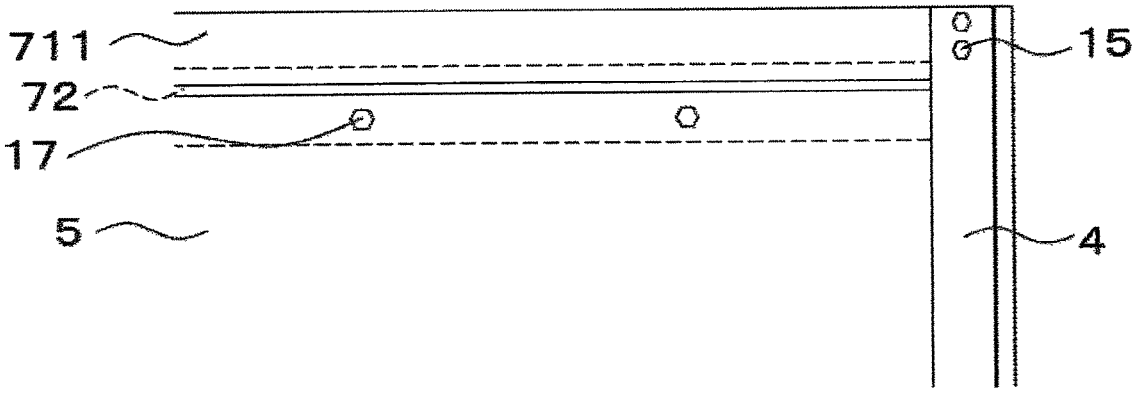
FIG. 10 is an enlarged view showing a fastening portion between the ceiling plate and a side wall.

FIG. 10 is an enlarged view showing a fastening portion between the ceiling plate 72 and the side wall 5. As shown in FIG. 10, an upper portion of each side wall 5 is brought into contact with an outer face of the corresponding side vertical portion 721*a* of the ceiling plate 72 (a side face thereof on the opposite side to the other side vertical portion 721*a*) and fastened thereto by the bolts 17. Similarly, respective upper end portions of the front facing wall and the end rail 6 are brought into contact with an outer face of the rear vertical portion 722*a* of the ceiling plate 72 (a side face thereof on the opposite side to the front vertical portion 723*a*) and an outer face of the front vertical portion 723*a* of the ceiling plate 72 (a side face thereof on the opposite side to the rear vertical portion 722*a*), respectively, and fastened thereto by the bolts 17. As a result, a load exerted on the ceiling plate 72 is diffused to the side walls 5, the front facing wall, and the end rail 6, and therefore sufficient rigidity can be obtained in the ceiling plate 72 to withstand the weight of a maintenance worker or a heavy component placed thereon during installation or maintenance without attaching a reinforcing material to the ceiling plate 72.

Figure 8:
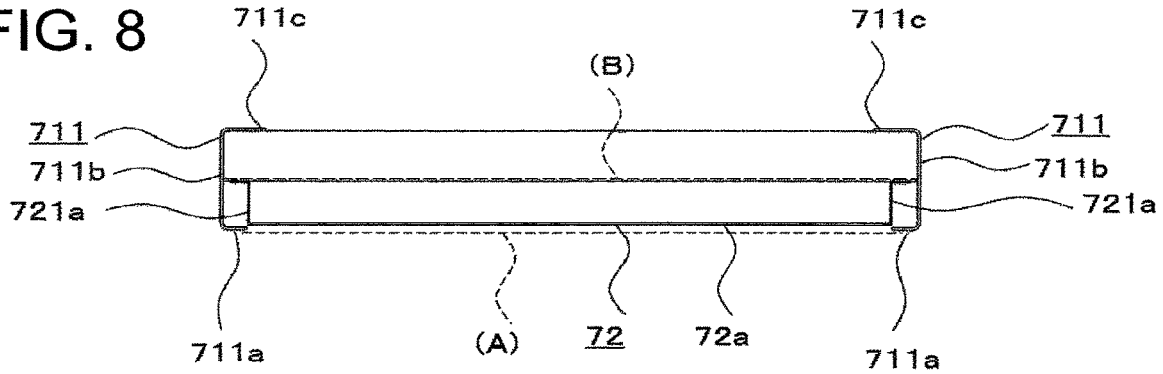
FIG. 8 is a front view showing the ceiling unit according to the first embodiment of this invention in a transportation condition.

FIG. 7 is a front view showing the ceiling unit 7 in an installation condition, and FIG. 8 is a view showing the ceiling unit 7 in a transportation condition. The ceiling unit 7 may be shipped in either the condition shown in FIG. 7 or the condition shown in FIG. 8.

As shown in FIGS. 4 and 5, keyholes 11 constituted by a small diameter hole and a large diameter hole connected to the small diameter hole are formed respectively in one lengthwise direction end portion of the horizontal portion 713*a* of the front beam 713 and one lengthwise direction end portion of the horizontal portion 714*a* of the upper beam 714. Further, keyholes 11 of an identical shape and size are formed in the lower horizontal portion 711*a* of the side beam 711 in positions vertically beneath the keyholes 11 in the respective lengthwise direction end portions (of the keyholes 11 formed in the side beam 711, the keyhole 11 corresponding to the upper beam 714 is not shown in the drawings). Keyholes 11 are formed likewise in the other lengthwise direction end portions of the front beam 713 and the upper beam 714, and keyholes 11 are formed likewise in the other side beam 711 so as to correspond to the keyholes 11 formed in the other lengthwise direction end portions. The keyholes 11 are formed such that the large diameter hole is located further toward the doorway 10 side than the small diameter hole.

In FIG. 8, the respective upper faces of the side horizontal portions 721*b* of the ceiling plate 72 contact the lower face of the horizontal portion 713*a* of the front beam 713 and the lower face of the horizontal portion 714*a* of the upper beam 714. The side horizontal portions 721*b* of the ceiling plate 72 are provisionally fastened thereto by bolts (not shown) via elongated holes 13 in the side horizontal portions 721*b* and the small diameter holes of the keyholes 11 in the front beam 713. Further, the side horizontal portions 721*b* of the ceiling plate 72 are provisionally fastened thereto by bolts (not shown) via the elongated holes 13 in the side horizontal portions 721*b* and the small diameter holes of the keyholes 11 in the upper beam 714. A diameter of the small diameter hole forming the keyhole 11 is set to be smaller than a diameter of a head portion of the bolt and larger than a diameter of a shaft portion of the bolt. Further, a diameter of the large diameter hole of the keyhole 11 is set to be larger than the diameter of the head portion of the bolt. Hence, the ceiling plate 72 can be provisionally fastened to the front beam 713 and the upper beam 714 easily by passing bolts through the elongated holes 13 and attaching nuts thereto so that the bolts are held on the ceiling plate 72, and in this condition, passing the head portions of the bolts through the large diameter holes of the keyholes 11 and then moving the bolts into the small diameter holes. When the upper frame 71 is provisionally fastened to the ceiling plate 72 in this manner, as shown in FIG. 8, the design surface of the ceiling plate 72 is disposed in a higher position than the horizontal plane (A) on which the lower horizontal portions 711*a* of the side beams 711 and the horizontal portion 712*a* of the rear beam 712 are disposed, and therefore the ceiling plate 72 does not contact the respective upper surfaces of the lower horizontal portions 711*a* of the side beams 711. When the ceiling unit 7 is shipped in this condition, there is no risk of the design surface of the ceiling plate 72 being damaged during transportation, and therefore the amount of packaging material used to wrap the ceiling unit 7 can be reduced.

Having been shipped and transported in the transportation condition shown in FIG. 8, the ceiling unit 7 is transferred to an installation site and deformed into the installation condition shown in FIG. 7. First, the bolts provisionally fastening the side horizontal portions 721*b* of the ceiling plate 72 to the horizontal portion 713*a* of the front beam 713 and the horizontal portion 714*a* of the upper beam 714 are loosened, whereupon the ceiling plate 72 is shifted toward the doorway 10 side of the car 1 relative to the upper beam 714. Accordingly, the head portions of the bolts move out of the small diameter holes in the keyholes 11 toward the large diameter hole side so that the bolts can be removed from the keyholes 11, and as a result, the side horizontal portions 721*b* of the ceiling plate 72 can be removed from the horizontal portion 713*a* of the front beam 713 and the horizontal portion 714*a* of the upper beam 714.

Even after the side horizontal portions 721*b* of the ceiling plate 72 are removed from the horizontal portion 713*a* of the front beam 713 and the horizontal portion 714*a* of the upper beam 714, the bolts fastening the ceiling plate 72 to the front beam 713 and the upper beam 714 remain attached to the elongated holes 13 in the ceiling plate 72. When the ceiling plate 72 is moved downward, the lower surfaces of the side horizontal portions 721*b* respectively contact the upper surfaces of the lower horizontal portions 711*a* of the side beams 711. At this time, the bolts attached to the elongated holes 13 in the ceiling plate 72 pass through the large diameter holes of the keyholes 11 provided in the lower horizontal portions 711*a* of the side beams 711. When the ceiling plate 72 is then moved to the far side, the rear horizontal portion 722*b* of the ceiling plate 72 contacts the upper surface of the horizontal portion 712*a* of the rear beam 712, whereby the bolts connecting the elongated holes 13 in the ceiling plate 72 to the keyholes 11 in the side beams 711 move from the large diameter holes of the keyholes 11 into the small diameter holes. The ceiling plate 72 is then fixed to the upper frame 71 by tightening these bolts and also fastening the bolt holes 12 provided in the lower horizontal portions 711*a* of the side beams 711 and the horizontal portion 712*a* of the rear beam 712 to the bolt holes 12 provided in the side horizontal portions 721*b* and the rear horizontal portion 722*b* of the ceiling plate 72 fully using bolts (not shown), and as a result, the installation condition shown in FIG. 7 is realized.

Hence, the ceiling unit 7 can be deformed easily from the transportation condition shown in FIG. 8 to the installation condition shown in FIG. 7. Note that during installation of the car 1, the ceiling unit 7 may be fastened to the upper portions of the upright columns 4 while in the transportation condition shown in FIG. 8, and after fastening the ceiling unit 7 to the upright columns 4, the ceiling plate 72 may be moved so as to realize the installation condition shown in FIG. 7. When the ceiling unit 7 is fastened to the upper portions of the upright columns 4 while in the transportation condition shown in FIG. 8, there is no risk of damage to the design surface of the ceiling plate 72, and therefore an installation operation can be performed easily.

Note that the pair of side beams 711 are each fastened to the upper portions of two upright columns 4, but instead, each side beam 711 may be fastened to the upper portion of one upright column 4. Further, the upright columns 4 are erected in the four corners of the floor plate 3, but this invention is not limited thereto. For example, the upright columns 4 may be erected in central portions of the sides to which the side walls 5 are attached in addition to the four corners of the floor plate 3. In this case, the pair of side beams 711 are each fastened to the upper portions of three upright columns 4.

The ceiling unit 7 according to this embodiment includes the first side beam 711 supported by at least one of the plurality of upright columns 4 erected on the floor plate 3, and the second side beam 711 supported parallel to the first side beam 711 by a different upright column 4 from the upright column 4 supporting the first side beam 711. The ceiling unit 7 also includes the rear beam 712 that connects the respective rear side end portions of the first and second side beams 711. The ceiling plate 72 is supported by the first and second side beams 711 and the rear beam 712. As a result, the ceiling unit 7 can be formed by integrating the ceiling plate 72 with the first and second side beams 711 and the rear beam 712 forming the upper frame 71, enabling a reduction in the number of components thereof. Moreover, the ceiling plate 72 is supported by the upper frame 71, and therefore the weight exerted on the side walls 5 of the cab can be reduced. Accordingly, members that are comparatively low in strength can be used as the side walls 5, and as a result, the mass of the car 1 can be reduced.

Further, in the ceiling unit 7 according to this embodiment, the first and second side beams 711 respectively include contact surfaces that contact the lower surface of the ceiling plate 72. Furthermore, the ceiling unit 7 includes the front beam 713 disposed above the respective contact surfaces of the first and second side beams 711 at a remove from the respective contact surfaces so as to connect the respective front side end portions of the first and second side beams 711, and the upper beam 714 disposed above the respective contact surfaces of the first and second side beams 711 at a remove from the respective contact surfaces so as to connect the respective central portions of the first and second side beams 711. Hence, the first and second side beams 711 are connected to the front beam 713 and the upper beam 714 as well as the rear beam 712, and therefore the rigidity of the ceiling unit 7 can be improved. Moreover, the ceiling plate 72 is laid across the first and second side beams 711, and therefore the ceiling plate 72 can be prevented from falling even when the ceiling plate 72 becomes unfastened from the first and second side beams 711.

Furthermore, in the ceiling unit 7 according to this embodiment, the lower surface of the front beam 713 and the lower surface of the upper beam 714 are disposed on an identical horizontal plane. Accordingly, the ceiling plate 72 can be fastened provisionally to the lower surface of the front beam 713 and the lower surface of the upper beam 714 during transportation of the ceiling unit 7, thereby eliminating the risk of damage to the design surface of the ceiling plate 72, and as a result, the amount of packaging material used to wrap the ceiling unit 7 can be reduced.

Moreover, in the ceiling unit 7 according to this embodiment, the rear beam 712 has a contact surface that contacts the lower surface of the ceiling plate 72. Furthermore, the respective contact surfaces of the first and second side beams 711 and the contact surface of the rear beam 712 are disposed on an identical horizontal plane. Hence, the ceiling plate 72 is laid across the rear beam 712 as well as the first and second side beams 711, and therefore the rigidity of the ceiling unit 7 can be improved and the ceiling plate 72 can be prevented from falling.

The keyholes 11 serving as fastening holes, each of which is constituted by a small diameter hole and a large diameter hole connected to the small diameter hole, are provided in both lengthwise direction ends of each of the front beam 713 and the upper beam 714, and the keyholes 11 serving as fastening holes having the same shape as the connecting holes are provided in the first and second side beams 711 in positions vertically beneath the keyholes 11 serving as the fastening holes. As a result, the ceiling plate 72 can be held in contact with and fastened provisionally to the respective lower surfaces of the horizontal portion 713*a* of the front beam 713 and the horizontal portion 714*a* of the upper beam 714 during transportation. The design surface of the ceiling plate 72 is disposed in a higher position than the horizontal plane (A) on which the lower horizontal portions 711*a* of the side beams 711 and the horizontal portion 712*a* of the rear beam 712 are disposed, and therefore the risk of damage to the design surface is eliminated.

Furthermore, the ceiling plate 72 forming the ceiling unit 7 according to this embodiment includes the mutually opposing first and second vertical portions 721*a*, the third vertical portion 722*a* provided between the respective rear side end portions of the first and second vertical portions 721*a*, the first and second horizontal portions 721*b* and the third horizontal portion 722*b* connected respectively to the upper end portions of the first and second vertical portions 721*a* and the third vertical portion 722*a* so as to extend outward from the upper end portions, and the bottom portion 72*a* connecting the lower end portions of the first and second vertical portions 721*a* and the third vertical portion 722*a* to each other. As a result, the vertical portions 721*a*, 722*a* can function as ceiling baseboards, enabling reductions in the number of components and the mass of the car 1.

Further, in the ceiling unit 7 according to this embodiment, the ceiling plate 72 is configured such that the first and second horizontal portions 721*b* are carried on the first and second side beams 711 and the third horizontal portion 722*b* is carried on the rear beam 712. Hence, the ceiling plate 72 is configured such that the horizontal portions 721*b* are carried on the lower horizontal portions 711*a* of the side beams 711 and the horizontal portion 721*b* of the rear beam 712, and as a result, the ceiling plate 72 can be prevented from falling even when the ceiling plate 72 becomes unfastened from the side beams 711 and the rear beam 712.

Moreover, in the ceiling unit 7 according to this embodiment, the first and second vertical portions 721*a*, the first and second horizontal portions 721*b*, and the bottom portion 72*a* of the ceiling plate 72 are formed from a single plate. Hence, the ceiling plate 72 formed from a single plate is configured such that the respective outer faces of the vertical portions 721*a* are fastened to the side walls 5, and therefore sufficient strength can be obtained therein to withstand the weight of a maintenance worker or a heavy component placed thereon during installation or maintenance.

Furthermore, the elevator car 1 according to this embodiment includes the first side wall 5 erected on the floor plate 3 of the elevator car, the second side wall 5 erected on the floor plate 3 of the elevator car so as to oppose the first side wall 5, the front facing wall (not shown) erected on the floor plate 3 of the elevator car so as to oppose the doorway 10 of the elevator, and the ceiling unit 7, in which the bottom portion 72*a* of the ceiling plate 72 is oriented toward the floor plate 3 side, and in this condition, the respective outer faces of the first and second vertical portions 721*a* of the ceiling plate 72 are brought into contact with and fastened to inner faces of the first and second side walls 5, and the third vertical portion 722*a* of the ceiling plate 72 is brought into contact with and fastened to an inner face of the front facing wall. Hence, the ceiling plate 72 is molded by bending the four sides thereof upward so as to form the respective side vertical portions 721*a*, the rear vertical portion 722*a*, and the front vertical portion 723*a*, and the respective outer faces of these vertical portions are fastened to the side walls 5, the front facing wall, and the end rail 6, with the result that sufficient rigidity can be obtained. Accordingly, there is no need to attach a reinforcing material to the ceiling plate 72, and therefore the number of components thereof can be reduced and the installation operation can be performed easily. Moreover, the ceiling unit 7 is in an integrated condition from the time of shipping and can be installed in that condition, and as a result, the installation operation can be performed easily.

Note that in this embodiment, the four vertical portions and four horizontal portions are formed by bending the four sides of a single plate, but it is sufficient to form the side vertical portions 721*a* and the side horizontal portions 721*b* by bending at least a pair of opposing sides. In this case, the vertical portions 722*a*, 723*a* and the horizontal portions 721*b*, 722*b* positioned on the far side and the doorway 10 side of the car 1 are formed by attaching separate members. Likewise in this case, the ceiling plate 72 can be prevented from falling and the installation operation can be performed easily.

Further, the ceiling plate 72 may be formed in a planar shape instead of forming the vertical portions 721*a*, 722*a*, 723*a* and horizontal portions 721*b*, 722*b*, 723*b*. In this case, a dimension of the ceiling plate 72 in a width direction of the doorway 10 is set to be larger than a frontage width between the lower horizontal portions 711*a* of the side beams 711 so that the ceiling plate 72 is laid across the respective upper faces of the lower horizontal portions 711*a* of the side beams 711. As a result, the ceiling plate 72 can be prevented from falling and the installation operation can be performed easily.

Note that as a method of winding a rope (not shown) used to raise and lower the car 1, either a so-called underslung method, in which the rope is wound around a lower portion and side faces of the car 1, or a so-called hanging method, in which end portions of the rope are attached to the upper beam 714, may be applied.

Also note that although the side beams 711 and the rear beam 712 are fastened to the ceiling plate 72 via the bolt holes 12, the side beams 711 and the rear beam 712 may be fixed by welding.

Second Embodiment

Figure 11:
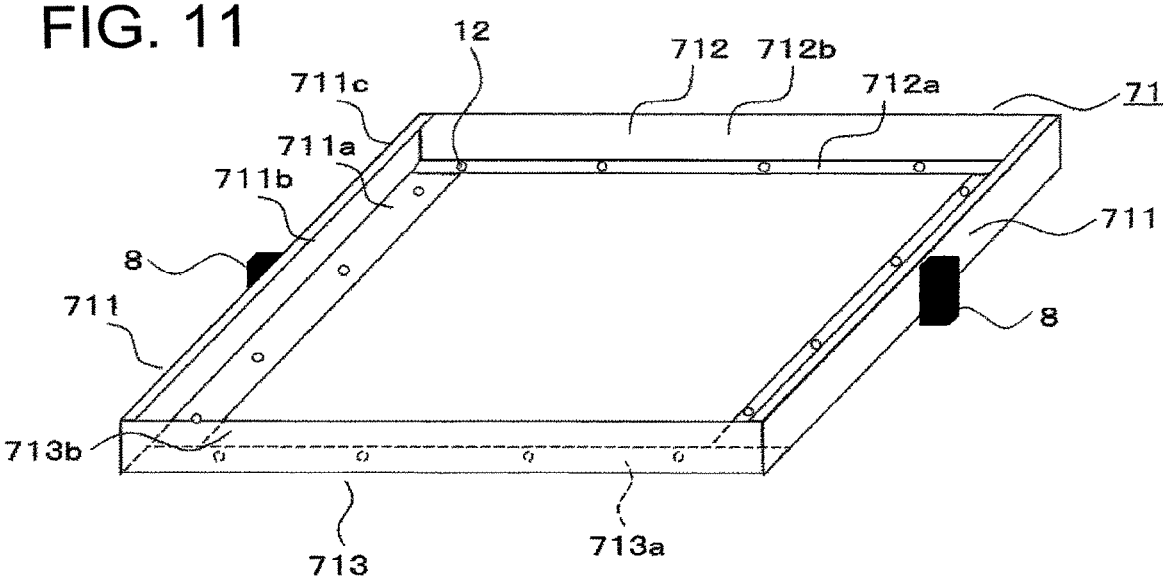
FIG. 11 is a perspective view showing an upper frame according to a second embodiment of this invention.

In the first embodiment, the horizontal portion 713*a* of the front beam 713 is disposed in a higher position than the horizontal portions 711*a* of the side beams 711 and the horizontal portion 712*a* of the rear beam 712, but the horizontal portion 713*a* of the front beam 713 may be provided at an identical height. FIG. 11 is a perspective view showing the upper frame 71 according to this embodiment. As shown in FIG. 11, the horizontal portion 713*a* of the front beam 713 is formed so as to be bent toward the far side of the car 1, and the bolt holes 12 are provided in the horizontal portion 713*a* to fasten the horizontal portion 713*a* to the front horizontal portion 723*b* of the ceiling plate 72.

The lower horizontal portion 711*a* of each side beam 711 is formed by bending a central part of the steel sheet while leaving unbent a part having a dimension that corresponds to the front-rear dimension of the horizontal portion 712*a* of the rear beam 712 from the far side end face and a part having a dimension that corresponds to the front-rear dimension of the horizontal portion 713*a* of the front beam 713 from the front side end face. Accordingly, the length from the front side end face to the far side end face of the lower horizontal portion 711*a* is shorter than the length from the front side end face to the far side end face of the upper horizontal portion 711*c* by an amount corresponding to a sum of the front-rear dimension of the horizontal portion 712*a* of the rear beam 712 and the front-rear dimension of the horizontal portion 713*a* of the front beam 713. Furthermore, the far side and the front side of the steel sheet, which remain after the lower horizontal portion 711*a* is formed, extend vertically downward so as to form the vertical portion 711*b*.

One lengthwise direction end portion of the front beam 713 is welded to the front side (the doorway 10 side) end portion of one of the side beams 711. More specifically, a rear face of the lengthwise direction end portion of the horizontal portion 713*a* of the front beam 713 is brought into contact with a front side end face of the lower horizontal portion 711*a* of the side beam 711. The end face of the horizontal portion 713*a* of the front beam 713 on the side beam 711 side is brought into contact with the side face of the vertical portion 711*b* of the side beam 711 on the front beam 713 side. The end face of the vertical portion 713*b* of the front beam 713 on the side beam 711 side is brought into contact with the side face of the vertical portion 711*b* of the side beam 711 on the front beam 713 side. An upper end face of the vertical portion 713*b* of the front beam 713 is brought into contact with the lower face of the upper horizontal portion 711*c* of the side beam 711. In this condition, the upper horizontal portion 711*c* is welded to the vertical portion 713*b*, the vertical portion 713*b* is welded to the vertical portion 711*b*, the horizontal portion 713*a* is welded to the vertical portion 711*b*, and the horizontal portion 713*a* is welded to the lower horizontal portion 711*a*. The other lengthwise direction end portion of the front beam 713 is welded to the front side end portion of the other side beam 711 in a similar manner. As a result, the front beam 713 connects the respective front side end portions of the pair of side beams 711.

The rear beam 712 is connected to the pair of side beams 711 using a similar method to the first embodiment. Likewise in this embodiment, when the pair of side beams 711, the rear beam 712, and the front beam 713 are joined together, the upper frame 71 takes a rectangular shape.

Here, the upper horizontal portion 711*c* of each side beam 711 is formed to have a narrower width in the frontage direction of the doorway 10 of the car 1 than in the first embodiment. Further, a distance by which the upper horizontal portions 711*c* of the pair of side beams 711 are removed from each other is set to be longer than a dimension from the side face of one of the side horizontal portions 721*b* of the ceiling plate 72 on one side beam 711 side to the side face of the other side horizontal portion 721*b* on the other side beam 711 side. Furthermore, the upper beam 714 is not provided. The ceiling plate 72 can be inserted from the upper side into the upper frame 71 constituted by the side beams 711, the rear beam 712, and the front beam 713. The side horizontal portions 721*b*, rear horizontal portion 722*b*, and front horizontal portion 723*b* of the ceiling plate are fastened respectively to the lower horizontal portions 711*a* of the side beams 711, the horizontal portion 712*a* of the rear beam, and the horizontal portion 713*a* of the front beam. As a result, the ceiling unit 7 is formed.

In this embodiment, the car 1 is installed by implementing similar procedures to the first embodiment. The ceiling unit 7 is fastened to the upright columns 4 in a condition corresponding to the installation condition of the first embodiment, shown in FIG. 7. Similarly to the first embodiment, the respective outer faces of the side vertical portions 721*a* of the ceiling plate 72 (the side faces thereof on the opposite side to the other side beam 711) are fastened to the outer faces of the side walls 5, the outer face of the rear vertical portion 722*a* (the side face thereof on the opposite side to the front beam 723) is fastened to the outer face of the front facing wall, and the outer face of the front vertical portion 723*a* (the side face thereof on the opposite side to the rear beam 722) is fastened to the outer face of the end rail 6.

Likewise in the second embodiment, the ceiling unit 7 is formed by integrating the upper frame 71 and the ceiling plate 72, enabling a reduction in the number of components thereof. Moreover, the ceiling plate 72 is supported by the upper frame 71, and therefore the weight exerted on the side walls 5 of the cab can be reduced. Accordingly, members that are comparatively low in strength can be used as the side walls 5, and as a result, the mass of the car can be reduced.

Further, similarly to the first embodiment, the ceiling plate 72 is molded by bending the four sides thereof upward so as to form the respective side vertical portions 721*a*, the rear vertical portion 722*a*, and the front vertical portion 723*a*, and these vertical portions are fastened to the side walls 5, the front facing wall (not shown), and the end rail 6, with the result that sufficient rigidity can be obtained. Hence, there is no need to attach a reinforcing material to the ceiling plate 72, and therefore the number of components thereof can be reduced and the installation operation can be performed easily. Moreover, the ceiling unit 7 is in an integrated condition from the time of shipping and can be installed in that condition, and as a result, the installation operation can be performed easily.

Note that in this embodiment, the vertical portions and horizontal portions are formed by bending the four sides of the ceiling plate 72, but it is sufficient to form the side vertical portions 721*a* and the side horizontal portions 721*b* by bending at least a pair of opposing sides. In this case, the vertical portions 722*a*, 723*a* and the horizontal portions 722*b*, 723*b* positioned on the far side and the doorway 10 side of the car 1 are formed by attaching separate members. Likewise in this case, the ceiling plate 72 can be prevented from falling and the installation operation can be performed easily.

Further, the ceiling plate 72 may be formed in a planar shape instead of forming the vertical portions 721*a*, 722*a*, 723*a* and horizontal portions 721*b*, 722*b*, 723*b*. In this case, the dimension of the ceiling plate 72 in the width direction of the doorway 10 is set to be larger than the frontage width between the lower horizontal portions 711*a* of the side beams 711 so that the ceiling plate 72 is laid across the respective upper faces of the lower horizontal portions 711*a* of the side beams 711. As a result, the ceiling plate 72 can be prevented from falling and the installation operation can be performed easily.

Furthermore, the upper horizontal portion 711*c* of each side beam 711 is formed such that the width thereof in the frontage direction of the doorway 10 of the car 1 is narrower than in the first embodiment, but the side beam 711 may be formed without the upper horizontal portion 711*c* so as to have an L-shaped cross-section.

In the ceiling unit 7 according to this embodiment, the first and second side beams 711 respectively include contact surfaces that contact the lower surface of the ceiling plate 72, the front beam 713 is provided to connect the respective front side end portions of the first and second side beams 711, and the frontage between the respective upper portions of the first and second side beams 711 is set to be wider than the dimension of one side of the ceiling plate 72. Accordingly, the ceiling plate 72 is inserted and fastened from above the upper frame 71, and as a result, the installation operation can be performed easily. Moreover, the ceiling plate 72 is carried on the side beams 711, and therefore the ceiling plate 72 can be prevented from falling even when the ceiling plate 72 becomes unfastened from the side beams 711.

Likewise in this embodiment, either the so-called underslung method, in which the rope (not shown) is wound around the lower portion and side faces of the car 1, or the so-called hanging method, in which the end portions of the rope are attached to the upper beam 714, may be applied as the method of winding the rope used to raise and lower the car 1.

Likewise in this embodiment, although the side beams 711 and the rear beam 712 are fastened to the ceiling plate 72 via the bolt holes 12, the side beams 711 and the rear beam 712 may be fixed by welding.

REFERENCE SIGNS LIST

1 Car
2 Lower frame
3 Floor plate
4 Upright column
5 Side wall
6 End rail
7 Ceiling unit
71 Upper frame
711 Side beam
712 Rear beam
713 Front beam
714 Upper beam
711*a* Lower horizontal portion
711*c* Upper horizontal portion
712*a*, 713*a*, 714*a* Horizontal portion
711*b*, 712*b*, 713*b*, 714*b* Vertical portion
72 Ceiling plate
72*a* Bottom portion
721*a* Side vertical portion
721*b* Side horizontal portion
722*a* Rear vertical portion
722*b* Rear horizontal portion
723*a* Front vertical portion
723*b* Front horizontal portion
8 Guide shoe
9 Guide rail
10 Doorway
11 Keyhole
12, 14, 16 Bolt hole
13 Elongated hole
15, 17 Bolt

The invention claimed is:

1. A ceiling unit comprising:
a first side beam supported by at least one of a plurality of upright columns erected on a floor plate of an elevator car;
a second side beam supported parallel to the first side beam by a different upright column, among the plurality of upright columns, from the upright column supporting the first side beam;
a rear beam that connects respective rear side end portions of the first and second side beams; and
a ceiling plate supported by the first and second side beams and the rear beam,
wherein the first and second side beams respectively include contact surfaces that contact a lower surface of the ceiling plate, and
the ceiling unit further comprises:
a front beam disposed separately from the contact surfaces so as to connect respective front side end portions of the first and second side beams; and
an upper beam disposed above the respective contact surfaces separately from the respective contact surfaces so as to connect respective central portions of the first and second side beams.

2. The ceiling unit according to claim 1, wherein a lower surface of the front beam and a lower surface of the upper beam are disposed on an identical horizontal plane.

3. The ceiling unit according to claim 1, wherein
the rear beam has a contact surface that contacts the lower surface of the ceiling plate, and
the respective contact surfaces of the first and second side beams and the contact surface of the rear beam are disposed on an identical horizontal plane.

4. The ceiling unit according to claim 1, wherein
first fastening holes, each constituted by a small diameter hole and a large diameter hole connected to the small diameter hole, are provided in both lengthwise direction ends of each of the front beam and the upper beam, and
second fastening holes having the same shape as the first fastening holes are provided in the first and second side beams in positions vertically beneath the first fastening holes.

5. A ceiling unit comprising:
a first side beam supported by at least one of a plurality of upright columns erected on a floor plate of an elevator car;
a second side beam supported parallel to the first side beam by a different upright column, among the plurality of upright columns, from the upright column supporting the first side beam;
a rear beam that connects respective rear side end portions of the first and second side beams; and
a ceiling plate supported by the first and second side beams and the rear beam, wherein the first and second side beams include contact surfaces that contact a lower surface of the ceiling plate, and
the ceiling unit further includes a front beam disposed above the contact surfaces, the front beam of the ceiling unit is directly connected to the first and second side beams.

6. The ceiling unit according to claim 5, wherein
the front beam of the ceiling unit connects respective front side end portions of the first and second side beams, and
a gap between respective upper portions of the first and second side beams is set to be wider than a dimension of one side of the ceiling plate.

7. The ceiling unit according to claim 5, wherein the ceiling plate includes:
mutually opposing first and second vertical portions;
a third vertical portion provided between respective rear side end portions of the first and second vertical portions;
first, second, and third horizontal portions connected to respective upper end portions of the first, second, and third vertical portions so as to extend outward from the upper end portions; and
a bottom portion connecting respective lower end portions of the first, second, and third vertical portions to each other.

8. The ceiling unit according to claim 7, wherein the first and second horizontal portions of the ceiling plate are carried on the first and second side beams, and the third horizontal portion thereof is carried on the rear beam.

9. The ceiling unit according to claim 7, wherein the first and second vertical portions, the first and second horizontal portions, and the bottom portion of the ceiling plate are formed from a single sheet of plate material.

10. An elevator car comprising:
a first side wall erected on a floor plate of the elevator car;

a second side wall erected on the floor plate of the elevator car so as to oppose the first side wall;

a front facing wall erected on the floor plate of the elevator car so as to oppose a doorway of the elevator; and the ceiling unit according to claim 7, in which the bottom portion of the ceiling plate is oriented toward the floor plate, and in this condition, respective outer faces of the first and second vertical portions of the ceiling plate are brought into contact with and fastened to respective inner faces of the first and second side walls, and the third vertical portion of the ceiling plate is brought into contact with and fastened to an inner face of the front facing wall.

* * * * *